US006511015B1

(12) United States Patent
Heikkiläet al.

(10) Patent No.: US 6,511,015 B1
(45) Date of Patent: Jan. 28, 2003

(54) METHOD AND APPARATUS FOR STABILIZING THE RUNNING OF A WEB IN A PAPER MACHINE OR A LIKE

(75) Inventors: Pertti Heikkilä, Raisio (FI); Olli Huhtala, Littoinen (FI); Heli Kankare, Turku (FI); Richard Solin, Kemiö (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/936,458

(22) PCT Filed: Mar. 17, 2000

(86) PCT No.: PCT/FI00/00214

§ 371 (c)(1),
(2), (4) Date: Sep. 13, 2001

(87) PCT Pub. No.: WO00/58551

PCT Pub. Date: Oct. 5, 2000

(30) Foreign Application Priority Data

Mar. 18, 1999 (FI) ..... 990605

(51) Int. Cl.[7] ..... B65H 23/24; F26B 3/34

(52) U.S. Cl. ..... 242/615.11; 34/267; 34/273; 226/97.3

(58) Field of Search ..... 242/615.11; 226/97.3; 34/267, 273, 445, 455, 117, 119, 124

(56) References Cited

U.S. PATENT DOCUMENTS 3,680,223 A * 8/1972 Vits ..... 242/615.11 X
3,837,551 A * 9/1974 Schregenberger ..... 242/615.11
4,137,644 A 2/1979 Karlsson
4,384,666 A 5/1983 Kopenen et al.
4,881,327 A 11/1989 Hauser et al.
4,893,416 A 1/1990 Vits
4,932,140 A 6/1990 Lepistö
5,014,447 A * 5/1991 Hagen ..... 242/615.11 X
5,752,641 A * 5/1998 Klas et al. ..... 226/97.3
5,829,166 A * 11/1998 Klas ..... 226/97.3 X
6,088,930 A * 7/2000 Robin et al. ..... 34/267
6,289,603 B1 * 9/2001 Lescanne et al. ..... 34/60

* cited by examiner

*Primary Examiner*—Kathy Matecki
*Assistant Examiner*—Minh-Chau Pham
(74) *Attorney, Agent, or Firm*—Lathrop & Clark LLP

(57) ABSTRACT

A method and a device for stabilizing the web run in a paper machine or the like having a blow suction module (12) mounted above and/or below the web. The blow suction module comprises a blow nozzle unit (14) extending across the web, through which gas, such as air or combustion gas, is blown against the web (10) from the blow nozzle unit, and a first air discharge unit (18) arranged on the front side of the blow nozzle unit, and a second air discharge unit (22) arranged on the back side of the blow nozzle unit, which remove air or gas from between the web and the blow suction module. The blow suction module is asymmetric regarding the first and second air discharge units, so that more air or gas is discharged via the first air discharge unit than via the second air discharge unit.

20 Claims, 4 Drawing Sheets t t

METHOD AND APPARATUS FOR STABILIZING THE RUNNING OF A WEB IN A PAPER MACHINE OR A LIKE

BACKGROUND OF THE INVENTION

The present invention relates to a method and a device defined below in the introductory parts of the independent claims for stabilising the web run in a paper machine or the like.

The invention relates typically to a method and a device for stabilising the web run in a paper machine or the like where the web is heated and/or dried by gas infras or the like. In these devices blow suction modules are arranged in connection with the gas infras, typically between the gas infras, in order to stabilise the web run, to improve the runnability, to make the heat and mass transfer more effective, to prevent the web from touching the gas infra structures, to utilise the exhaust gases of the gas infra for drying and for stabilising the web run, and/or to remove combustion gas from the web area.

A typical blow suction module or box comprises

- a blow nozzle unit, such as a Float or Foil nozzle of the applicant, which has at least one gap nozzle extending mainly across the web or a corresponding nozzle arrangement extending mainly across the web,
- a first air discharge unit extending mainly across the web and being arranged on the front side of the blow nozzle unit, as seen in the travel direction of the web, and having a suction nozzle extending mainly across the web or some other corresponding suction arrangement extending across the web, and
- a second air discharge unit extending mainly across the web and being arranged on the back side of the blow nozzle unit, as seen in the travel direction of the web, and having a suction nozzle extending mainly across the web or some other corresponding suction arrangement extending across the web.

The blow nozzle unit or units of the blow suction module blow a gas against the surface of the web, such as combustion gas sucked from the gas infras adjacent to the blow suction unit, air sucked from the web area, replacement air, or other air or gas. Typically the blow nozzle unit comprises a nozzle surface which is parallel to the web and in the connection of which there are arranged the actual blow nozzles, such as one or more gap nozzles or a row of nozzle openings extending across the web, from which nozzles gas can be blown against the web in a desired manner.

The air discharge unit or units of the blow suction module are arranged to suck gas, such as air and/or gas discharged from the gas infras, from the region between the air discharge unit and the web. The air discharge units comprise typically a bottom plate or a corresponding surface, to which there are arranged one or more suction gaps or suction nozzles, such as suction openings.

The suction zones on each side of the blow nozzle unit are thus mainly arranged to suck back air which is blown from the nozzle, and combustion gas which is blown from the adjacent gas infra or the like, and/or flushing gases used in the infra, which thus can be returned to be utilised again. Further the blow nozzle unit sucks air transported by the web.

Disadvantageous blowing and suction arrangements can cause flutter in the web and thus impair the runnability. The fluttering may cause the web to touch the gas infra, which easily results in a web break or which may cause a danger of fire.

The gas infras further tend to react on the air flow created between them and the web, in which case the air flow easily interferes with the function of the radiator in the gas infra. The air flows hitting the radiator element decrease the efficiency of the radiator and they may even extinguish the flame of the infra radiator.

SUMMARY OF THE INVENTION

The object of the present invention is to provide an improvement regarding the above presented problems in a paper machine or the like.

One object of the invention is then to optimise the flow field in the region of the blow suction modules so that the creation of detrimental flows is prevented.

It is particularly an object to provide a blow suction module with which the runnability can be improved by minimising the reasons for a flutter created in the above described way.

An object of the invention is also to improve the efficiency of gas infras or the like used in paper machines or the like, by minimising the air flows hitting the radiators.

In order to attain the above mentioned objects the method and the device according to the invention are characterised in that what is defined in the characterising clauses of the independent claims presented below.

Now it has surprisingly been found that

- in a dryer which uses symmetric blow suction modules, i.e. modules where both air discharge units suck equal amounts of gas from between the module and the web, there is easily created vibration or flutter in the web, which impairs the runnability and decreases the effect of the gas infra, whereas
- in a dryer which uses asymmetric blow suction modules, i.e. modules having a air discharge unit on the front side which sucks more gas than that on the back side, the flutter and vibration can be substantially decreased.

It has been found, that because the air layer transported by the web is discharged mainly on the front side of the blow suction module, it must be possible to remove a sufficient amount of air on the front side. If this is not possible, it can interfere with the function of the module nozzle. On the other hand, the situation is made worse by a too strong air removal at the back side.

The problem becomes bigger when the speed of the web increases. This can be assumed to be due to the fact that when the speed increases the web itself will transport more air with it, which causes a need for an increased asymmetric air removal at the entry and exit sides of the blow suction module.

In the solution according to the invention the aim is to optimise the flow field around the blow nozzle with the aid of an asymmetric control or structure of the air discharge units, so that the air flows disturbing the web run are minimised and an optimal runnability is achieved. This is particularly useful, especially at high web speeds.

A nozzle module according to the invention can be particularly advantageously used in connection with an infra dryer as a system which stabilises the web and effectivates the evaporation. The solution according to the invention enables the use of over-pressure nozzles in the gas infra drying in order to improve the runnability and to effectivate the heat and mass transfer. Then there are suction zones on both sides of the nozzles, through which zones both air blown from the over-pressure nozzles and combustion gas of the infra radiator and/or flushing air is sucked back. According to the invention these gases and air flows can be sucked back smoothly without causing problems. In this way the web flutter is avoided, and in addition also harmful air flows directed at the infra radiator are avoided.

The suction is typically arranged to be asymmetric, so that the larger part of the sucked air and/or gas is discharged at the entry side of the blow suction module, and the smaller part at the exit side.

An asymmetric suction can be provided for instance so that the air discharge unit or the suction zone of the blow suction module is smaller at the exit side than at the entry side of the module. An asymmetric suction can be provided also by control dampers, with which the negative pressure in the different air discharge units can be controlled to have different magnitudes. Then the negative pressure at the entry side is typically controlled to be greater than at the exit side.

The invention can be advantageously used in paper machines or in other corresponding machines, such as in paper board machines, in coating machines, in other finishing machines and in machines for further processing, where the heating and/or drying of the web is made at least partly by gas infras. The invention is particularly well suited to be used in coating machines for heating and drying the coated web immediately after the coating. However, the invention can also be applied otherwise than in connection with gas infras. An asymmetric blow suction module according to the invention can be used e.g. for cooling and evaporation when a good runnability and web stability is required.

BRIEF DESCRIPTION OF THE DRAWING

The invention is described in more detail below with reference to the enclosed drawing, in which.

DETAILED DESCRIPTION

Figure 1:
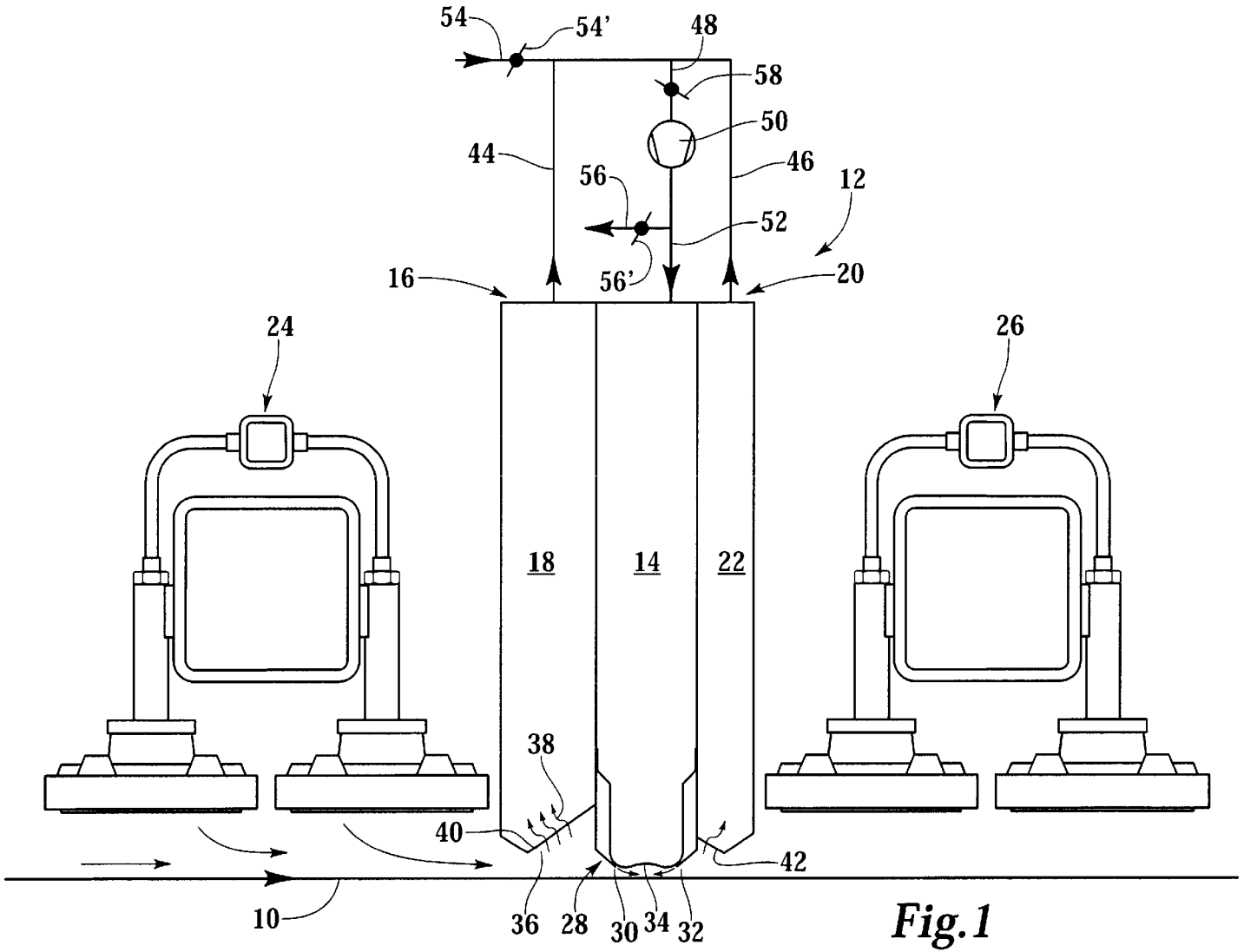
FIG. 1 shows schematically a cross section taken in the web direction of an exemplary blow suction module according to the invention mounted between two gas infras.

FIG. 1 shows an asymmetric blow suction module 12 according to the invention which is mounted above the web 10 of a paper machine, which module comprises a blow nozzle unit 14 having a first discharge suction unit 18 arranged on the front side 16 and a second discharge suction unit 22 on the back side 20. The blow suction module 12 is arranged between two gas infra modules 24 and 26.

The blow nozzle unit 14 is a Float over-pressure nozzle of the applicant, having against the web a bottom part 28 which has two nozzles or nozzle gaps 30, 32 on its sides in the transversal direction of the web, which nozzles are arranged to blow gas and/or air against each other along the nozzle surface 34 of the nozzle. The nozzle surface is convex, so that due to the so called Coanda effect the air jets blown from the nozzle gaps follow at least a short distance the nozzle surface, after which the air jets turn downwards against the web and eventually outwards, i.e. towards the air discharge units. The air jets blown from the nozzle gaps are typically discharged into different directions, the jets from the first nozzle 30 towards the first air discharge unit 18 and the jets from the second nozzle towards the second air discharge unit 22.

From the first gas infra 24 gas and/or air will flow towards the gap 36 between the first air discharge unit 18 and the web 10. Air transported by the web itself will also flow into the same gap. From the second gas infra 26 very little or no gas and/or air will flow into the second air discharge unit 22.

The first air discharge unit 18 is dimensioned to be so large that it is able to suck the gas and/or air coming from the first gas infra in a suitable manner. Correspondingly, the second air discharge unit 22 is dimensioned to be so small that it will not tend to suck so much gas and/or air from the region of the second gas infra 26, that it would create in this region, or between the second gas infra 26 and the second air discharge unit 22, a flow which is harmful to the radiator.

In the case shown in FIG. 1 the bottom part of both air discharge units have been provided with bottom plates 40, 42, which are bent downwards into a V-shape and which contain suction openings 38. Between on one hand those parts of the bottom plates 40, 42 which are closest to the blow nozzle unit and on the other hand the blow nozzle unit there is thus formed a space which tapers upward, and from which gas and/or air is sucked through the suction openings 38 into these units 18, 22.

The air discharge unit 18 and its bottom plate 40 are larger than the second air discharge unit 22 and its bottom plate 42. The total open area of the suction openings 38 in the bottom plate 40 is larger than the corresponding total open area of the suction openings of the corresponding second bottom plate 42. Thus the suction effect of the first air discharge unit 18 is substantially larger than the suction effect of the second air discharge unit 22.

The same effect could be created by units 18 and 22 of the same size or bottom plates 40, 42 of the same size, by arranging in the first unit a greater negative pressure 18 than in the second unit 22.

FIG. 1 shows also schematically the passage of the air/gas from the air discharge units 18, 22 to the blow nozzle unit 14. The air flows 44, 46 of both air discharge units are combined into a common air flow 48, which with the blower 50 is directed via the channel 52 into the blow nozzle unit 14. Additional air can be supplied through the channel 54 for instance into the common air flow 48. Excessive gas/air can be removed through the channel 56. With the valves 54' and 56' it is possible to control the supply of additional air and the removal of air. With the valve 58 or with the blower 50 it is on the other hand possible to control the suction effect of the air discharge units 18, 22, when required.

FIG. 1 shows a solution where the air removed by the discharge suction units 18, 22 from the web area is returned by the channels 44, 46, 48, 52 and the blower 50 into the blow nozzle unit 14 of the same blow suction module 12. It is of course possible to connect these channels and the blower to a plurality of blow suction modules. Then the air flows discharged from the plurality of blow suction modules can be combined and directed by the same blower into the blow nozzle unit of the plurality of blow suction modules. It is of course also possible to arrange the passage of gas and/or air in other ways.

Figure 2C:
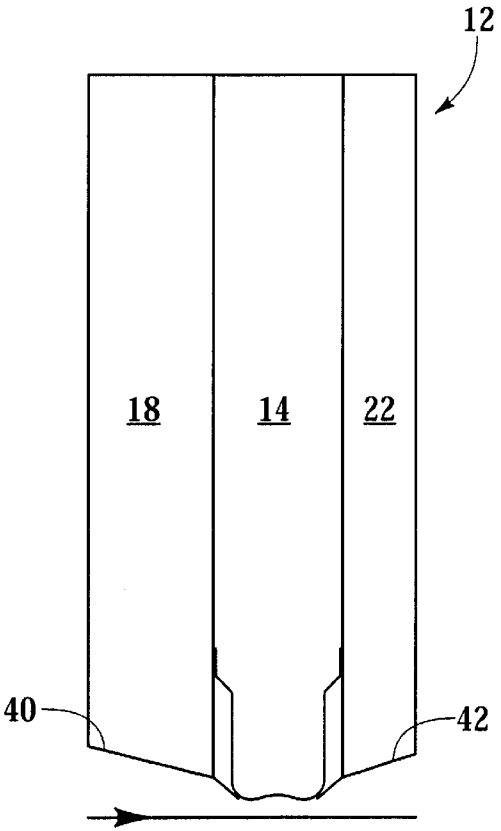
FIGS. 2*a*, 2*b* and 2*c* show according to FIG. 1 three different blow suction module solutions according to the invention.
Figure 2B:
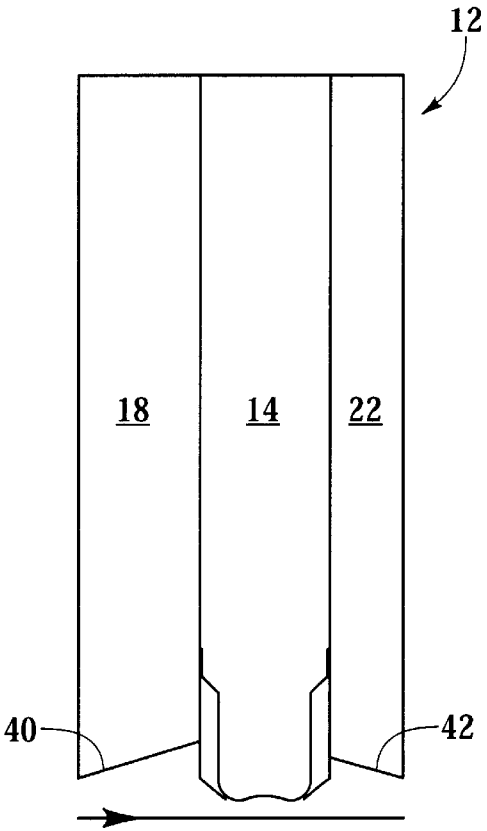
Figure 2A:
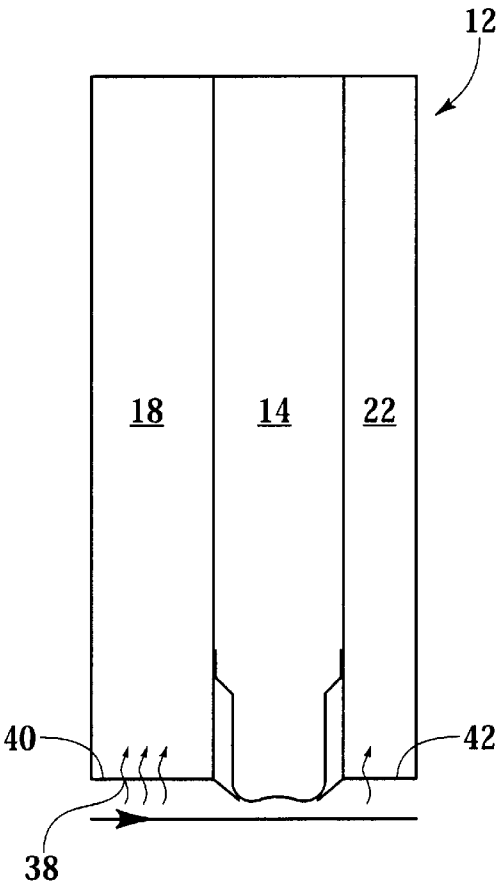

The FIGS. 2*a*, 2*b* and 2*c* show blow suction modules 12 with a bottom geometry of the discharge suction units differing from that shown in FIG. 1. In FIG. 2*a* the bottom plates 40, 42 of the discharge suction units 18, 22 are parallel with the web to be dried. The area of the bottom plate of the discharge suction unit on the front side, as well as the total open area of the suction openings 38 in this bottom plate, is larger than the corresponding areas of the discharge suction unit on the back side. In FIG. 2*b* the bottom plates of the discharge suction units 18, 22 are upwards inclined toward the centre of the blow suction modules. The bottom plate 40 on the front side has a larger area than the bottom plate on the back side. In FIG. 2*c* the bottom plates of the discharge suction units 18, 22 are downwards inclined towards the centre of the blow suction modules.

Figure 3A:
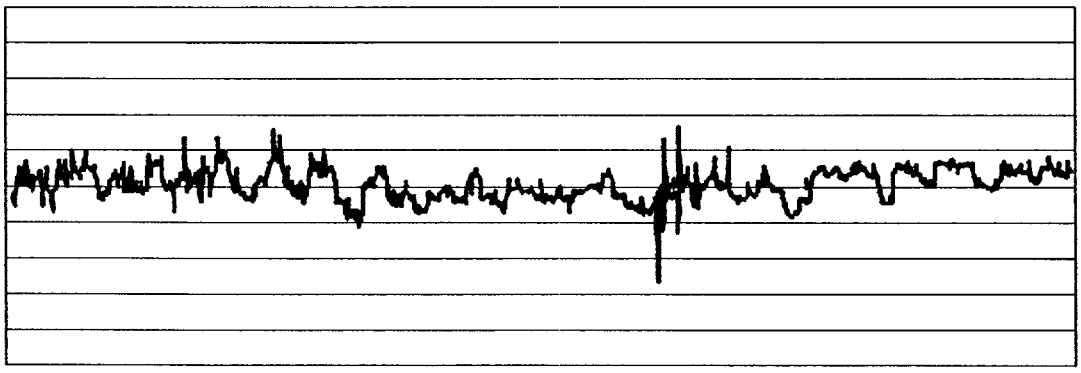
FIGS. 3*a* and 3*b* show as a function of time the flutter of a web being dried, measured between two blow suction modules, in a drier which does not use the solution according to the invention, and in a drier which uses the solution according to the invention, respectively.

FIG. 3*a* shows as a function of time the flutter of a web being dried, measured between two adjacent modules, in a drier which blow suction module uses air discharge units of the same size, i.e. symmetrical units, on the front and the back sides of the blow suction module.

Figure 3B:
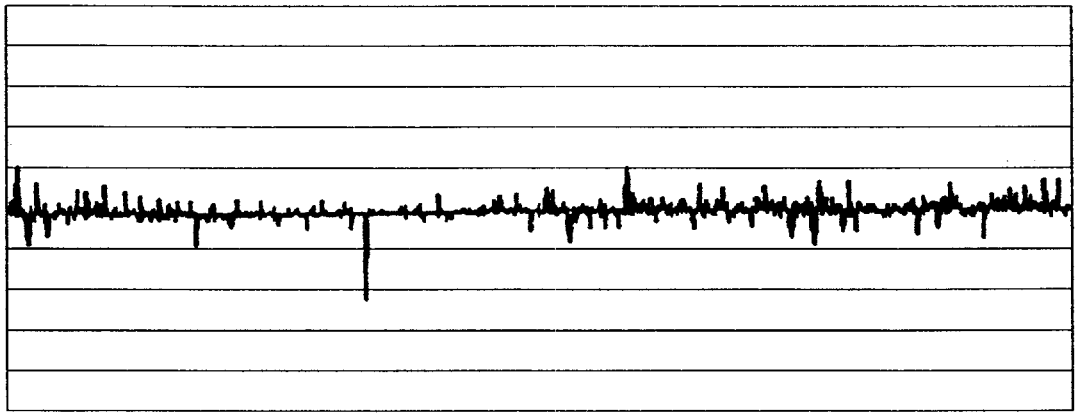

FIG. 3*b* shows the corresponding web flutter in a drying solution which uses an asymmetric blow suction module according to the invention, i.e. where air discharge units of different sizes are used on the front and the back sides. In the FIGS. 3*a* and 3*b* can be seen that the asymmetric air discharge units will considerably reduce the flutter of the web.

Figure 4:
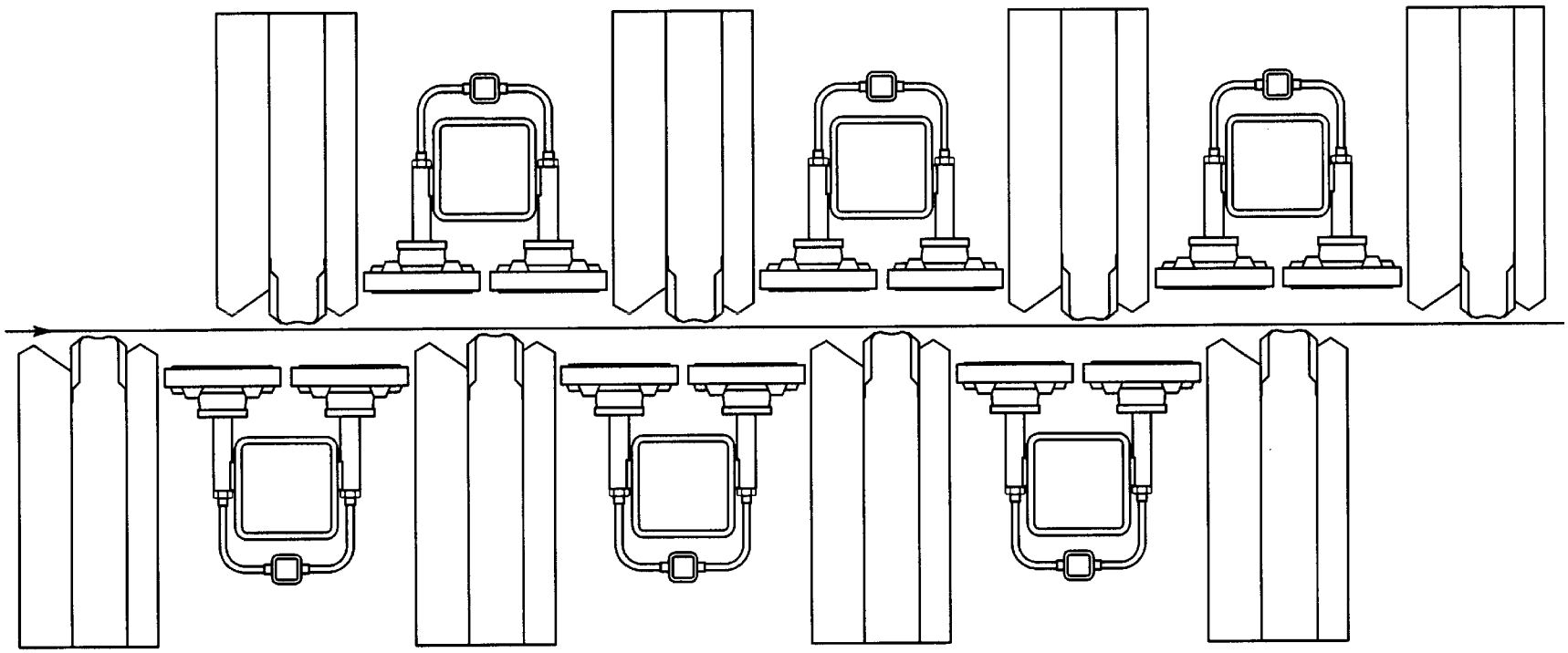
FIG. 4 shows schematically a drier where a number of consecutive blow suction modules according to the invention are mounted on both sides of the web.

FIG. 1 shows a blow suction module according to the invention when it is mounted above the web. Corresponding modules can be mounted below the web, when desired. The modules can be mounted directly against each other on different sides of the web, or in a zig-zag pattern, as shown in FIG. 4. In FIG. 4 a module is mounted under the web in the middle between two modules above the web.

The invention is not intended to be limited to the above presented application which was presented as an example, but on the contrary, the invention is intended to be widely applicable within the scope defined by the claims presented below.

What is claimed is:

1. A method for stabilizing a web in a paper handling machine, comprising the steps of:

mounting a blow suction module to extend across the web;

blowing gas through at least one gap nozzle extending across the web in a blow nozzle unit which forms a part of the blow suction module;

removing gas from between the web and the blow suction module at a first rate through a first suction nozzle extending across the web, the first suction nozzle being part of a first gas discharge unit, the first gas discharge unit extending across the web and arranged on the front side of the blow nozzle unit, as seen in the travel direction of the web; and removing gas from between the web and the blow suction module at a second rate, which is less than the first rate, through a second suction nozzle extending across the web, the second suction nozzle being part of a second gas discharge unit, the second gas discharge unit extending across the web, and arranged on the back side of the blow nozzle unit, as seen in the travel direction of the web, in order to stabilize the web run and optimize runnability of the web.

2. The method of claim 1, wherein a greater negative pressure is maintained in the first gas discharge unit than in the second gas discharge unit.

3. The method of claim 1, wherein the first suction nozzle defines a first open area, and the second suction nozzle defines a second open area, and wherein the first open area is larger than the second open area.

4. The method of claim 1, further comprising at least one gas infra unit for drying the web, the at least one gas infra unit having a front side and a back side, and wherein the blow suction module is arranged on the back side of the gas infra device, and wherein the gas discharge unit on the front side of the blow suction module removes combustion gases flowing from a gap defined between the gas infra device and the web towards a gap defined between the blow suction module and the web.

5. The method of claim 4 further comprising the step of mounting a second blow suction module to extend across the web on the front side of the gas infra unit, and wherein the second blow suction module has a gas discharge unit is mounted on the back side thereof to be arranged on the entry side of the gas infra device to remove combustion gases flowing from a gap between the gas infra device and the web towards a gap between the second blow suction module and the web.

6. A device for stabilizing a web in a paper machine comprising a blow suction module mounted across the web, the module comprising:

a blow nozzle unit, which has at least one nozzle extending across the web so as to blow gas against the web, a first gas discharge unit extending across the web and being arranged on the front side of the blow nozzle unit, as seen in the travel direction of the web, and the first gas discharge unit having a suction nozzle extending across the web, the suction nozzle having at least one suction opening for removing gas from between the web and the blow suction module; and a second gas discharge unit extending across the web and being arranged on the back side of the blow nozzle unit, as seen in the travel direction of the web, and the second gas discharge unit having a suction nozzle extending across the web, the suction nozzle having at least one suction opening for removing gas from between the web and the blow suction module, configured so that when the blow suction module is operated more gas is drawn from the front side first gas discharge unit than the back side second gas discharge unit of the blow suction module.

7. The device of claim 6, wherein the first gas discharge unit suction nozzle has an open area, and wherein the second gas discharge unit suction nozzle has an open area, and wherein the first gas discharge unit suction nozzle open area is larger than the second gas discharge unit suction nozzle open area.

8. The device of claim 6, wherein a negative pressure in the first gas discharge unit is greater than in a second gas discharge unit.

9. The device of claim 6, wherein the first gas discharge unit has a bottom which is at least partly formed by an inclined bottom plate, so that an upwardly tapering gas space is formed between the bottom plate and the blow nozzle unit, and wherein the at least one suction opening of the first gas discharge unit is formed in the inclined bottom plate.

10. The device of claim 9, wherein the second gas discharge unit has a bottom which is at least partly formed by an inclined bottom plate, so that an upwardly tapering gas space is formed between the second gas discharge unit bottom plate and the blow nozzle unit, and wherein the at least one suction opening of the second gas discharge unit is formed in the second gas discharge unit inclined bottom plate.

11. The device of claim 10, wherein the bottom plate of the first gas discharge unit is larger than the bottom plate of the second gas discharge unit.

12. The device of claim 6 further comprising at least one gas infra for drying a web having an inlet side and an exit side, wherein the blow suction module is mounted on the exit side of the at least one gas infra device.

13. The device of claim 6 further comprising at least two gas infras for drying a web, each gas infra having an inlet side and an exit side, wherein a blow suction module is arranged on both the entry side and the exit side of at least one of said two gas infras.

14. The device of claim 6, wherein at least one blow suction module is arranged on a first side of a web, and at least one blow suction module is arranged on a second side of the web.

15. An apparatus for drying a web comprising:

a plane along which a paper web can be caused to travel, defining an upstream direction and a downstream direction;

a plurality of first infra gas heaters positioned above the plane, alternating with a plurality of first blow suction modules;

a plurality of second infra gas heaters positioned below the plane, alternating with a plurality of second blow suction modules, wherein the second infra gas heaters are positioned below and opposite the first blow suction modules, and wherein the second blow suction modules are positioned below and opposite the first infra gas heaters;

each of said first blow suction modules and each of said second blow suction modules being comprised of an upstream suction unit having a suction opening, a blow unit having at least one gap nozzle, and a downstream suction unit having at least one suction opening; and wherein the upstream suction unit and the downstream suction unit of each blow suction module is configured to draw more gas from between the plane and the upstream suction unit than between the plane and the downstream suction unit.

16. The device of claim 15 wherein the upstream suction unit suction opening has an open area, and wherein the downstream suction unit suction opening has an open area, and wherein the upstream suction unit suction opening open area is larger than the downstream suction unit suction opening open area.

17. The device of claim 15, wherein a negative pressure in the upstream suction unit is greater than a negative pressure in the downstream suction unit.

18. The device of claim 15, wherein the upstream suction unit has a bottom which is at least partly formed by an inclined bottom plate, so that an upwardly tapering gas space is formed between the bottom plate and the blow unit, and wherein the suction opening of each upstream discharge unit is formed in the bottom plate.

19. The device of claim 18, wherein the downstream suction unit has a second bottom which is at least partly formed by an inclined second bottom plate, so that an upwardly tapering gas space is formed between the second bottom plate and the blow unit, and wherein said at least one suction opening of the downstream suction unit is formed in the second bottom plate.

20. The device of claim 19, wherein the bottom plate of the upstream suction unit is larger than the second bottom plate of the downstream suction unit.

* * * * *